United States Patent [19]

Feess et al.

[11] 3,955,226

[45] May 11, 1976

[54] PROCESS FOR HEAT FIXATION OF DYESTUFFS USING POLYESTER MATERIAL AS FILTER FOR CIRCULATING AIR STREAM

[75] Inventors: Erich Feess, Lorsbach, Taunus; Günther Trapp, Frankfurt am Main; Heinz Fleissner, Egelsbach, all of Germany

[73] Assignee: Hoechst Aktiengesellschaft, Frankfurt am Main, Germany

[22] Filed: Feb. 12, 1974

[21] Appl. No.: 441,855

[30] Foreign Application Priority Data

Feb. 14, 1973 Germany ..... 2307086

[52] U.S. Cl. ..... 8/149.2; 55/97; 55/528; 68/DIG. 5; 68/5 D; 68/18 F

[51] Int. Cl.[2] ..... D06B 3/02

[58] Field of Search ..... 68/DIG. 5, 5 D, 5 E, 68/8, 18 F, 20, 5 C, 7, 8; 8/149.2, 149.3; 34/82, 115, 122; 55/97, 528

[56] References Cited

UNITED STATES PATENTS

| | | | |
|---|---|---|---|
| 3,019,630 | 2/1962 | Fleissner et al. | 68/18 F X |
| 3,386,927 | 6/1968 | Rosecrans et al. | 55/97 X |
| 3,779,047 | 12/1973 | Fleissner | 68/5 D |

FOREIGN PATENTS OR APPLICATIONS

| | | | |
|---|---|---|---|
| 479,804 | 12/1951 | Canada | 68/5 D |
| 484,603 | 9/1953 | Italy | 8/149.3 |

*Primary Examiner*—Robert W. Jenkins
*Assistant Examiner*—Philip R. Coe
*Attorney, Agent, or Firm*—Curtis, Morris & Safford

[57] ABSTRACT

Process for the heat fixation of dyestuffs on textile flat articles using a steamer with directional air or vapor stream wherein the circulating air or vapor stream is purified from dyestuff particles by intercalating a filter.

2 Claims, 1 Drawing Figure

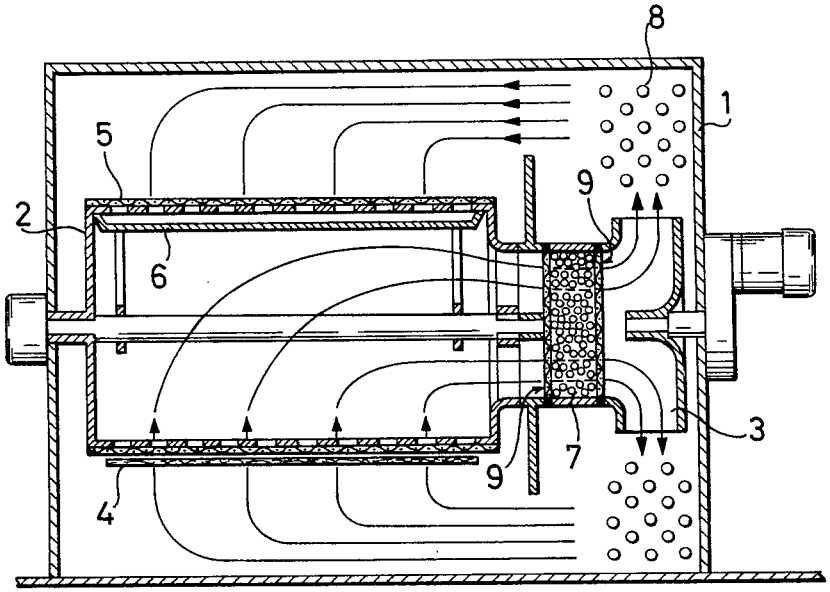
8
1
5
9
2
6
3
7
9
4

PROCESS FOR HEAT FIXATION OF DYESTUFFS USING POLYESTER MATERIAL AS FILTER FOR CIRCULATING AIR STREAM

The present invention relates to a process and a device for fixing dyestuffs on textile flat articles.

It is generally known how to fix, in the case of pad-dyeings and prints, the dyestuffs applied by a heat treatment by means of hot air, saturated steam, hot steam or solvent vapors on the corresponding fibre material. In practice the usual steamer constructions such as high-temperature steamers, stretching frames or drum driers are used for fixation by means of contact heat. Another special type of steamer, as described in German Offenlegungsschrift No. 1 460 523 is based on the principle of the sieve drum according to which a directional gas stream is suctioned from outside towards the inside through the material lying on the sieve drum. Due to the suction-pressure existing in the interior of the perforated drum, the padded or printed material is pressed against the sieve drum without any longitudinal strain; therefore, such steamer constructions are especially useful for knitted fabrics and circular knit goods, but also for loose material and fibre fleeces.

Moreover, these sieve drum steamers may be used alternately with hot air as a drier, with hot air for thermofixation and with saturated or over-heated steam for steaming; therefore, due to the multiple possibilities of use these steamers are called universal steamers.

Besides all these multiple advantages of application there is a severe inconvenience. Due to the high air or steam recirculation which is necessary, on one hand, for producing the suction-pressure in the sieve drum and, on the other hand, for the best possible productivity, and due to the industrially favorable thermosol and high-temperature-steaming processes, the requirements met by the dyestuffs used with regard to fastness, especially fastness to sublimation are very high, particularly for the fixation of disperse dyestuffs on synthetic fibre materials; therefore, soiling of the ground and dulling of the shades can only be avoided by an effective throttling of the air or steam recirculation. But this means that the resulting longer fixation periods avoid a complete utilization of the production capacity of these steamers and that, therefore, the essential object, i.e. a speedy and continuous rapid fixation cannot be obtained.

In the guidance of the air and vapor stream, conditioned by the construction of the steamer, the heated fixation medium is suctioned by means of a strong ventilator towards the inside through the material applied into the perforated drum, it is passed through the ventilator which blows the fixation medium into the air chamber or vapor-filled chamber, over radiators which dry the fixation medium, if necessary, and heat it up again; from the chamber it is suctioned again through the textile material into the inside of the drum. In this continuous circulation wherein the dyestuff particles subliming in the vapor-filled chamber on account of the high temperatures and the high air-blast velocity when passing through the padded or printed textile material, it is inevitable that they are absorbed by and dissolved in the material when being suctioned through it once more; these particles may cause a not repairable soiling of the white ground and/or a dulling of the shade.

It has now been found that these disadvantages in the heat fixation of dyestuffs on textile flat articles using a sieve drum steamer can be avoided by purifying the fixation medium circulating continuously in the sieve drum device by intercalation of a filter. The filter is installed in the directional air or vapor stream, advantageously before or immediately behind the ventilator. By this filter the fixation medium is purified quantitatively so that the gas cannot enter in contact with the new material before being filtered. Even in the case of the best possible production capacity with a very high air or vapor recirculation perfect white effects without any dulling of the shade are obtained. Moreover, by the easy and simple renewal of these filters the times of purification causing a standstill of the machines is considerably reduced.

It is advantageous to use as filter material suitable "solid" solvents or absorption agents for the dyestuffs considered. Thus, for example, it is most suitable in the fixation of disperse dyestuffs on textile materials of polyester, polyacrylonitrile and polyamide fibres, but also of regenerated fibres on the basis of cellulose 2 ½-acetate and cellulose triacetate, to feed the filter installed in the directional vapor or gas stream with polyester chips, loose polyester fibre material or several layers of filter cloths of optionally texturated woven or knitted polyester materials. By this process the sublimed dispersion dyestuff particles are not only absorbed from the air stream but really dissolved in the polyester substances due to the high fixation temperatures and thus, they are eliminated quantitatively from the air stream.

For the above-mentioned reasons such built-in filters are particularly necessary and suitable for sieve drum devices, but they can also be used in other fixation or drying apparatuses which are operated with a high circulating speed and a directional air or vapor stream.

A device suitable for carrying out the process essentially consists of a closed chamber 1 which contains the sieve drum 2 and the ventilator 3. To protect the textile material 4 the sieve drum is mostly covered with a close-meshed wire cloth 5. Inside the sieve drum is a fixed sheet cover 6 which covers a more or less big part of the drum surface from the inside so that there is no suction effect at this place and the textile material can be easily removed from or applied to the sieve drum. The ventilator produces an inducted draught in the interior of the drum, whereby the gas or vapor stream first passes through the filter 7 and is purified. The filter is separated towards the part of the drum and the part of the ventilator with metal sieves 9 and contains the absorption material in loose layers. After passing through the ventilator the gas or vapor stream is reconducted into the drum, if desired, while heating up with suitable heating elements 8.

The following Examples illustrated the invention.

EXAMPLE 1

60 g of the disperse dyestuff of the formula

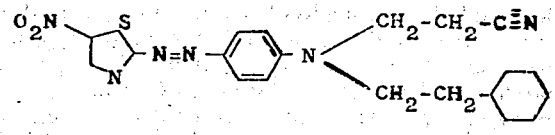

were first stirred to a paste with
100 g of cold water and then dispersed with
370 g of boiling water. This dispersion was introduced while stirring through a sieve into 500 g of an aqueous stock thickening consisting of a mixture of
990 g of a 9 % non-ionogenic locust bean flour ether thickening and
10 g of monosodium phosphate.

Then 30 g of an agent that accelerates fixation consisting of a mixture of
20 g of the reaction product of 1 mol of bisphenol A (diphenylol propane) with 30 mols of ethylene oxide,
20 g of the reaction product of 1 mol of stearyl alcohol with 6.5 mols of ethylene oxide, and
60 g of a polyethylene glycol having a molecular weight of about 400 were introduced while stirring.

A knitted fabric of texturated polyethylene-terephthalate fibres was printed with the printing paste described above, dried and, to fix the dyestuff, steamed in a sieve drum steamer for 6 minutes at 170°C with a best possible air recirculation. Subsequently the material was rinsed and soaped.

When working without any air filter a violet print having a good color yield but a strong soiling of the white ground was obtained.

However, when installing in the air stream behind the ventilator an air filter fed with loose polyester fibre material to absorb the subliming dyestuff, the violet print showed a considerably more brilliant shade on a perfect white ground.

EXAMPLE 2

40 g of the powdery disperse dyestuff of the formula

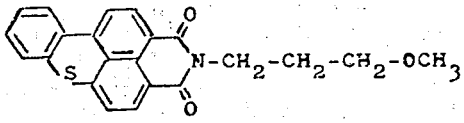

in a commercial form and composition were first stirred to a paste with 100 g of cold water and then dispersed with
325 g of hot water and introduced, while stirring, through a sieve into
550 g of thickening which consists of a mixture of identical parts of a 25 % aqueous crystal gum thickening and a 10 % aqueous solution of a commercial starch ether.

Then 25 g of an aqueous solution of
8 g of the sodium salt of the m-nitro-benzene-sulfonic acid and
2 g of monosodium phosphate were added.

A fabric of polyethylene terephthalate fibres was printed with the printing paste described above, dried and sprayed, with a liquor pick-up of 30 %, with a 10 % aqueous solution of a fixation accelerator consisting of 18 parts of a bi-oxethylated β-naphthol, 9 parts of butane-diol-(1,4)-pentaglycolethermonostearic acid ester, 1.5 parts of the calcium salt of the tetrapropylene-benzene-sulfonic acid and 1.5 parts of the addition product of 32 mols of ethylene oxide with 1 mol of ricinoleic acid. Then the material was steamed in a sieve drum steamer for 8 minutes at 180°C with the best possible air recirculation and finished as usual. Only after connecting in series an air filter fed with polyester chips in the vapor stream before the ventilator, a brilliant yellow print on a perfect white ground having excellent fastness properties were obtained with a very good color yield.

EXAMPLE 3

60 g of the disperse dyestuff of the formula

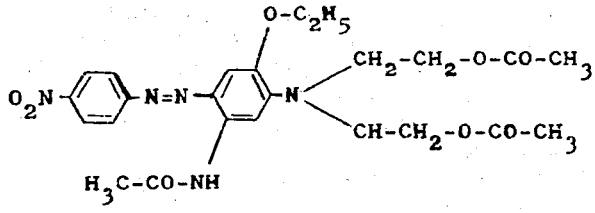

were first stirred to a paste with 100 g of cold water and then dispersed with
370 g of hot water and introduced, while stirring, through a sieve into
500 g of an aqueous stock thickening consisting of a mixture of
750 g of a 9 % non-ionogenic locust bean flour ether thickening
247 g of a 10 % anion-active starch ether thickening and
3 g of tartaric acid.

Subsequently 30 g of a fixation accelerator consisting of a mixture of
20 g of the reaction product of 1 mol of diphenyl-propane with 20 mols of ethylene oxide,
20 g of the reaction product of 1 mol of octanol with 20 mols of ethylene oxide, and
60 g of a polyethyleneglycol having a molecular weight of about 400 were added.

A fabric of cellulose triacetate was printed with this printing paste, dried, thermosoled to fix the dyestuff for 60 seconds at 195°C with hot air on a universal sieve drum steamer and after-treated as usual.

Whereas on the normal device the ground of the fabric was strongly soiled by subliming dyestuff particles, only the installation of an air filter consisting of several layers of a texturated polyester fabric into the directional air-stream behind the ventilator provided a brilliant yellow printed on a pure white ground.

With regard to the color yield and the good white ground the result was the same if instead of thermosoling with hot air steam was used on the same plate for 6 minutes at 180°C.

EXAMPLE 4

40 g of the disperse dyestuff of the formula

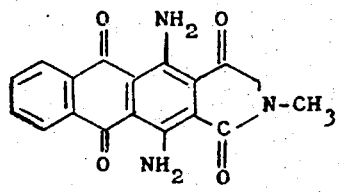

having the commercial form and composition were first stirred to a paste with 85 g of cold water and then dispersed with
250 g of boiling water and introduced, while stirring, through a sieve into
600 g of a thickening consisting of a mixture of identical parts of a 25 % aqueous crystal gum thickening and a 12 % aqueous solution of the addition compound of 10,000 mols of ethylene oxide with 1 mol of stearic acid.

Then 25 g of an aqueous solution of 8 g of the sodium salt of the m-nitrobenzenesulfonic acid and 2 g of monosodium phosphate as well as s 35 g of a fixation accelerator consisting of a mixture of 60 parts of the addition product of 4 mols of ethylene oxide with 1 mol of β-naphthol, 30 parts of butanediol-(1,4)-pentadecaglycol-ether monooleyl ester and 10 parts of the addition product of 25 mols of ethylene oxide with 1 mol of ricinoleic acid were added.

A fabric of cellulose triacetate was printed on a rouleaux printing machine with the above printing paste, dried, steamed for 5 minutes at 180°C to fix the dyestuff on a sieve drum steamer having the best possible air recirculation and ventilator power and finished as usual.

Only after connecting in series an air filter fed with polyester chips in the air stream before the ventilator, a clear blue print with very good fastnesses was obtained on a perfect white ground with an excellent color yield.

EXAMPLE 5

60 g of the disperse dyestuff of the formula

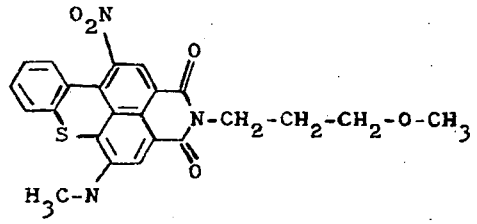

were first stirred to a paste with 100 g of cold water and subsequently dispersed with 270 g of boiling water and introduced, while stirring, through a sieve into 600 g of an aqueous thickening consisting of a mixture of 750 g of a 10 % anion-active sodium alginate thickening 245 g of a 10 % anion-active starch ether thickening and 5 g of citric acid.

Subsequently 30 g of a fixation accelerator consisting of a mixture of 20 g of the reaction product of 1 mol of diphenylol propane with 25 mols of ethylene oxide, 20 g of the reaction product of 1 mol of coconut oil alcohol with 5 mols of ethylene oxide, and 60 g of polyalkyleneglycol having a molecular weight of about 600 were added.

A fabric of polyethylene-terephthalate fibres was printed with the printing paste described above, dried and to fix the dyestufff thermosoled on a universal sieve drum steamer for 45 minutes with hot air of 195°C and finished as usual.

Whereas on the normal device, with the best possible ventilator power and air recirculation a strong soiling of the ground and dulling of the shade appeared by subliming dyestuff particles, the installation of an air filter fed with loose polyester fibre material into the directional air stream behind the ventilator permits to obtain, with an excellent color yield, a brilliant pink design on a perfect white ground.

We claim:

1. A process for the heat fixation of dyestuffs on textile articles comprising the steps of: passing a directional hot air of vapor flow through dyed or printed textile articles in a heat fixation zone; passing the said air or vapor flow coming from said fixation zone through a filter consisting of polyester material, in order to remove dyestuff particles from said air or vapor flow by absorption on said polyester material; and recirculating said air or vapor, from which the dyestuff particles have been removed, through said textile articles in said fixation zone.

2. In a process for the heat fixation of dyestuffs on textile articles wherein a directional air or vapor stream is passed through said textile articles in a heat fixation zone, the improvement consisting of: passing the air or vapor coming from said heat fixation zone through a filter consisting of polyester material, in order to remove particles of dyestuff from said air or vapor by absorption on said polyester material; and recirculating said air or vapor, from which dyestuff particles have been removed, through said textile articles in said fixation zone.

* * * * *